US006651556B2

(12) United States Patent
Richards

(10) Patent No.: US 6,651,556 B2
(45) **Date of Patent: *Nov. 25, 2003**

(54) DUAL-WEB OFFSET PRINTING PRESS AND METHOD FOR PRINTING DUAL WEBS

(75) Inventor: John S. Richards, Barrington, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,774

(22) Filed: Apr. 30, 1999

(65) Prior Publication Data

US 2002/0053294 A1 May 9, 2002

(51) Int. Cl.[7] ..... B41F 5/16
(52) U.S. Cl. ..... 101/178; 101/174
(58) Field of Search ..... 101/178, 181, 101/183, 179, 180, 171, 216

(56) References Cited

U.S. PATENT DOCUMENTS

| | | | | | |
|---|---|---|---|---|---|
| 2,504,021 | A | * | 4/1950 | Heinrich | 101/180 |
| 3,026,106 | A | * | 3/1962 | Bouldin | 101/180 |
| 4,125,073 | A | * | 11/1978 | Bain | 101/216 |
| 4,262,590 | A | * | 4/1981 | Bruckner | 101/216 |
| 4,412,490 | A | | 11/1983 | Grosshauser | 101/219 |
| 4,437,402 | A | | 3/1984 | Fischer | 101/181 |
| 5,063,844 | A | | 11/1991 | Fausel | 101/247 |
| 5,619,921 | A | * | 4/1997 | Iijima et al. | 101/181 |
| 5,836,245 | A | * | 11/1998 | Bolza-Schunemann | 101/181 |
| 5,907,997 | A | * | 6/1999 | Jackson et al. | 101/179 |
| 5,983,793 | A | * | 11/1999 | Volz et al. | 101/126 |
| 6,050,185 | A | | 4/2000 | Richards | 101/142 |
| 6,145,435 | A | | 11/2000 | Richards | 101/180 |
| 6,318,256 | B1 | * | 11/2001 | Hirai | 101/183 |
| 6,332,397 | B1 | * | 12/2001 | Bolza-Schunemann et al. | 101/216 |

FOREIGN PATENT DOCUMENTS

| | | |
|---|---|---|
| DE | 31 17 663 | 11/1982 |
| DE | 39 17 340 | 11/1990 |
| DE | 196 03 663 | 8/1997 |
| EP | 0 878 299 | 11/1998 |
| EP | 0 919 373 | 6/1999 |
| FR | 2377888 | 9/1978 |

* cited by examiner

*Primary Examiner*—Andrew H. Hirshfeld
*Assistant Examiner*—Anthony H. Nguyen
(74) *Attorney, Agent, or Firm*—Kenyon & Kenyon

(57) ABSTRACT

A web offset printing press for dual webs includes several printing units, each printing a color image on outer sides of a pair of webs. The webs travel through these printing units in a back-to-back arrangement. Additional printing units print another color image on the outer side. The webs may be separated during this process, with a pair of printing couples used for each web, so that one couple may print the additional image while the plate of the other is changed. The additional printing units also print a single-color image on the opposite side of each web.

13 Claims, 2 Drawing Sheets

DUAL-WEB OFFSET PRINTING PRESS AND METHOD FOR PRINTING DUAL WEBS

FIELD OF THE INVENTION

The present invention relates to web-offset printing presses. Specifically, the present invention relates to a web-offset printing press for simultaneously printing on two webs of paper and allowing an on-the-fly change of plate cylinders.

BACKGROUND OF THE INVENTION

In a web-offset printing press, an image is transferred to a web of paper by a blanket cylinder, which in turn receives the image from a printing plate cylinder, or simply plate cylinder. In many presses, plate cylinder/blanket cylinder pairs (referred to as 'couples'), are employed on opposite sides of a traveling web to print an image on both sides of the web simultaneously. In addition, multiple couples are often used on a single web side to achieve multiple-colored images. In many cases, for example in presses used to print newspapers, it is desirable to achieve a so-called 4/1 printing job, in which four couples are used to print a four-color image on one side of a web, while a single couple is used to print a one-color image (e.g. a black image) on the opposite side of the web.

A printing press capable of printing two 4/1 print jobs simultaneously is described in U.S. Pat. No. 6,145,435, filed Nov. 20, 1997 by John Richards entitled WEB-ROTARY PRINTING PRESS AND METHOD FOR SIMULTANEOUSLY PRINTING TWO WEBS, expressly incorporated herein by reference. According to that patent by the same inventor of the present application, a series of printing units (each unit including a pair of opposing couples) prints a four-color image on single sides of two webs which travel back-to-back through the press. The two webs are then separated, and additional units print a single-color image on the opposite side of each web.

One shortcoming of this and other printing presses is created by the fact that the presses must be stopped to accommodate, for example, edition changes of the newspaper. Edition changes require a different image to be placed on the web, but typically changes only occur for a single image on the first page. Accordingly, only a single plate cylinder, for example the plate cylinder printing a black image of a four-color image, needs to be changed for each web traveling through the press. Despite the fact that only one cylinder (for each web) needs to be changed, the entire conventional press must be halted in order to install the new plate cylinder.

French Patent Application No. 2 377 888 describes a printing press in which a web 8 is printed with multicolor images on both sides, is then printed with varnish or resin film and is afterwards superimposed with a synthetic web 9 and passed through a nip in order to obtain a printed image with a very high brilliance. According to FIG. 3 of this application, the two webs 8, 9 are printed on their respective sides and are afterwards either wound up on a bobbin or are fed to a group of cylinders where they are glued together in order to provide for a print carrier or support which is printed on its two outer faces. The whole print carrier is wound on the bobbin.

U.S. Pat. No. 4,412,490 discloses a paper web guiding mechanism. This patent does not teach or disclose passing two webs with their unprinted sides back-to-back through one or more blanket-to-blanket and then printing on the their unprinted sides.

SUMMARY OF THE INVENTION

A web-offset printing press according to the present invention includes, for example, three initial printing units for printing color images on outer sides of a pair of webs traveling through the press. The webs travel, for example, back-to-back through the press so that the outer side of each web receives the three images.

The press further includes, for example, three additional printing units. The first additional unit includes, for example, two couples, each of which can apply a fourth color image (e.g. a black image) to the outer sides of the two webs.

The next additional printing unit includes, for example, two couples. The webs may be separated before passing through this unit, so that only a single web passes through this unit. The first couple of this unit prints, for example, a single-color image on the inner side of one of the webs. The other couple of this unit prints, for example, the fourth color image to the outer side of that same web.

The third additional printing unit performs, for example, similar functions for the second of the two webs. This unit therefore includes, for example, two couples, one printing a single-color image on the inner side of the second web and the other printing the fourth color image to the outer side of the second web.

Because the exemplary press of the present invention includes two separate couples capable of printing the fourth color image for each web, the plate cylinder of one of these couples may be changed while the other is still printing. Thus one plate may be replaced, while still printing the entire 4/1 image on two webs simultaneously, without stopping the press.

DETAILED DESCRIPTION

Figure 1:
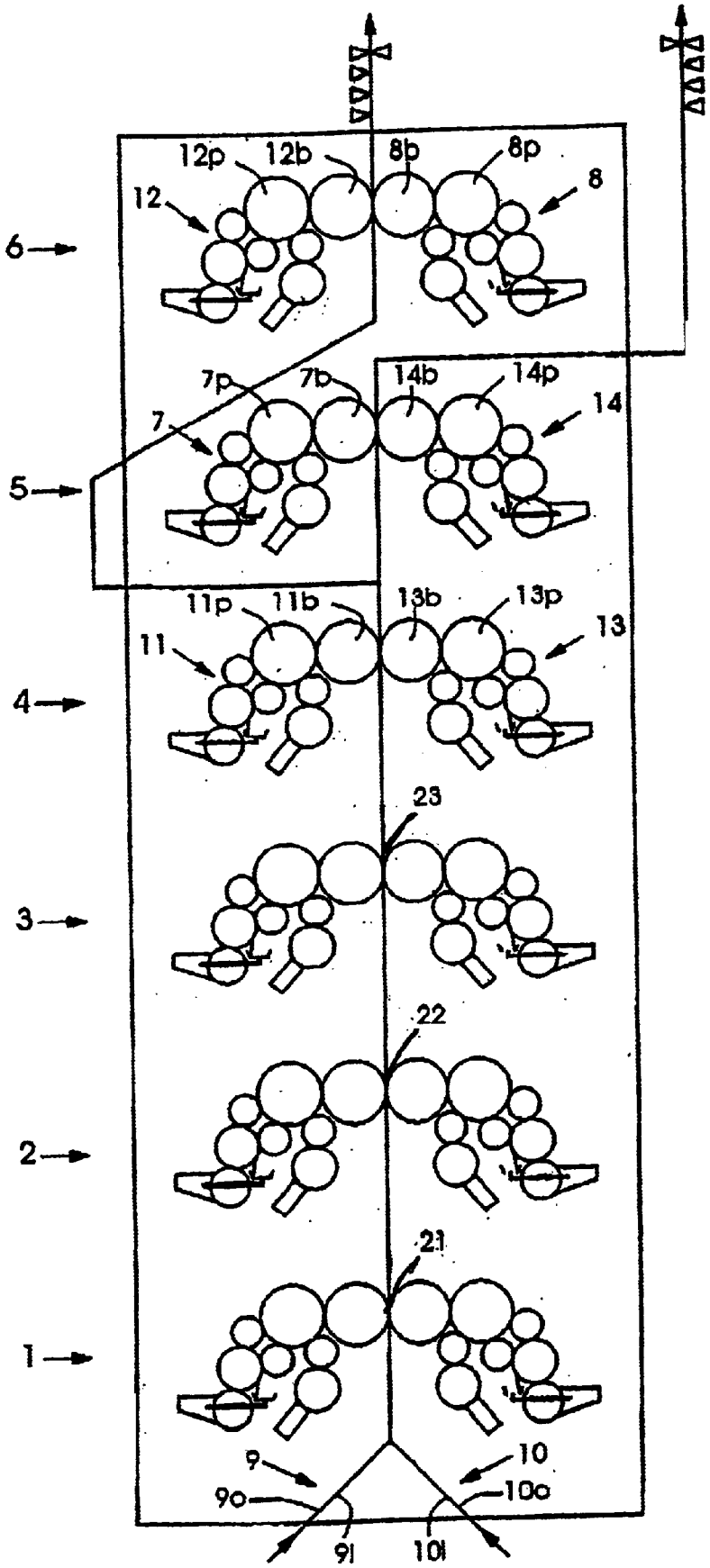
FIG. 1 is a schematic view of a web-offset printing press according to the present invention.

FIG. 1 shows an exemplary embodiment of a web-offset printing press according to the present invention. In this embodiment the press includes, for example, six printing units 1–6. Each of the printing units 1–6 may be, for example, a known web-offset printing unit having at least one plate cylinder and blanket cylinder group, referred to herein as a "couple." In the exemplary embodiment, each printing unit 1–6 includes a pair of couples arranged in opposition to one another so that the couples print on both sides of a web of paper traveling through the units 1–6. As can be seen from FIG. 1, the printing units 1–6 may be arranged linearly.

The exemplary press of FIG. 1 is arranged to print, for example, two 4/1 print jobs simultaneously. To achieve this object, two webs of paper 9, 10 are first arranged back-to-back. The phrase back-to-back should not be construed as a limitation on the orientation of the webs 9, 10 or the printing units 1–6. Rather, the phrase back-to-back is merely employed to designate an arrangement of the webs 9, 10 wherein the webs 9, 10 travel together through the print unit 1–6 and wherein an image is printed on the outer side 9*o* of one web 9 and an image is printed on the outer side 10*o* of the other web 10. The images printed on the sides 9*o* and 10*o* may be the same image or two different images. The inner sides 9*i* and 10*i* of webs 9, 10 (e.g. the sides facing each other in the back-to-back arrangement) do not receive an image while the webs are back-to-back.

It should be noted that back-to-back webs as defined herein are not necessarily in one hundred percent alignment, but rather may be misaligned. This misalignment could result from a natural misalignment occurring due to imperfect marrying of the webs, from an intentional small misalignment of like-sized-width webs for various purposes, or from an intentional combination product, such as a full-width web married for example to a ¾ width web. In this case, only part of the webs would be back-to-back, while part of one would be printed conventionally, i.e. not back-to-back.

The webs 9, 10 thus travel, for example, back-to-back through printing units 1, 2 and 3. The webs 9, 10 contact the blanket cylinders of the printing units 1, 2, and 3 at the "nips" 21, 22, and 23, respectively. In each printing unit 1–3, the outer sides 9*o* and 10*o* receive a different color image, for example cyan, magenta, and yellow.

The webs 9, 10 then travel, for example, through three additional printing units 4, 5, and 6. As will be seen, these printing units 4–6 print, for example, a fourth color image on the outer sides 9*o* and 10*o* of webs 9, 10 and a single-color image (e.g. a black image) on the inner sides 9*i* and 10*i* of webs 9, 10.

As shown in FIG. 1, printing unit 4 includes, for example, couples 11 and 13 forming a nip 24. Couple 11 includes, for example, a plate cylinder 11*p* and a blanket cylinder 11*b*. Couple 13 includes, for example, plate cylinder 13*p* and blanket cylinder 13*b*. Similarly, printing unit 5 may include couples 7 and 14, having plate cylinders 7*p* and 14*p* and blanket cylinders 7*b* and 14*b*, respectively, while printing unit 6 may include couples 8 and 12, having plate cylinders 8*p* and 12*p* and blanket cylinders 8*b* and 12*b*.

As can be seen in the exemplary embodiment of FIG. 1, webs 9, 10 travel through printing unit 4 back-to-back. The webs 9, 10 may then be separated, with web 10 passing through printing unit 5 and web 9 traveling around printing unit 5 and through printing unit 6. Couple 7 prints, for example, an image of the same color on the inner side 10*i* of web 10, and couple 8 prints, for example, the same single-color image on the inner side 9*i* of web 9. Couples 11 and 12 are alternatingly used, for example, to print the fourth color image on the outer side 9*o* of web 9. Likewise, couples 13 and 14 may be alternatingly used to print the fourth color image on the outer side 10*o* of web 10.

To further illustrate the exemplary embodiment, the path of web 9 through printing units 4 and 6 may be followed. As noted above, web 9 passes, for example, through printing unit 4 where it may receive the fourth color image on the outer side 9*o*. Web 9 receives the another color image, for example, from blanket cylinder 11*b* of couple 11. Because web 9 is still traveling back-to-back with web 10, couple 13 of printing unit 4 does not, for example, print an image on web 9.

Web 9 then may be directed around printing unit 5, e.g. by diverting rollers, to pass through printing unit 6. At printing unit 6, blanket cylinder 8*b* of couple 8 prints, for example, the single-color image on the inner side 9*i*. At the same time, blanket 12*b* of couple 12 may apply the fourth color image to outer side 9*o*.

As noted above, couples 11 and 12 work, for example, in an alternating fashion to print the fourth color image on the outer side 9*a*. This allows one of the plate cylinders 11*p* or 12*p* to be taken off impression and changed on the fly while the other continues to apply the fourth color image via its respective blanket cylinder 11*b* or 12*b*. When a plate is taken off impression, the blanket cylinder of the off-impression plate may continue rotating so that the opposing couple (e.g. couple 13 or 8) can continue to apply an image to the opposite side 9*i* of the web 9.

Figure 2:
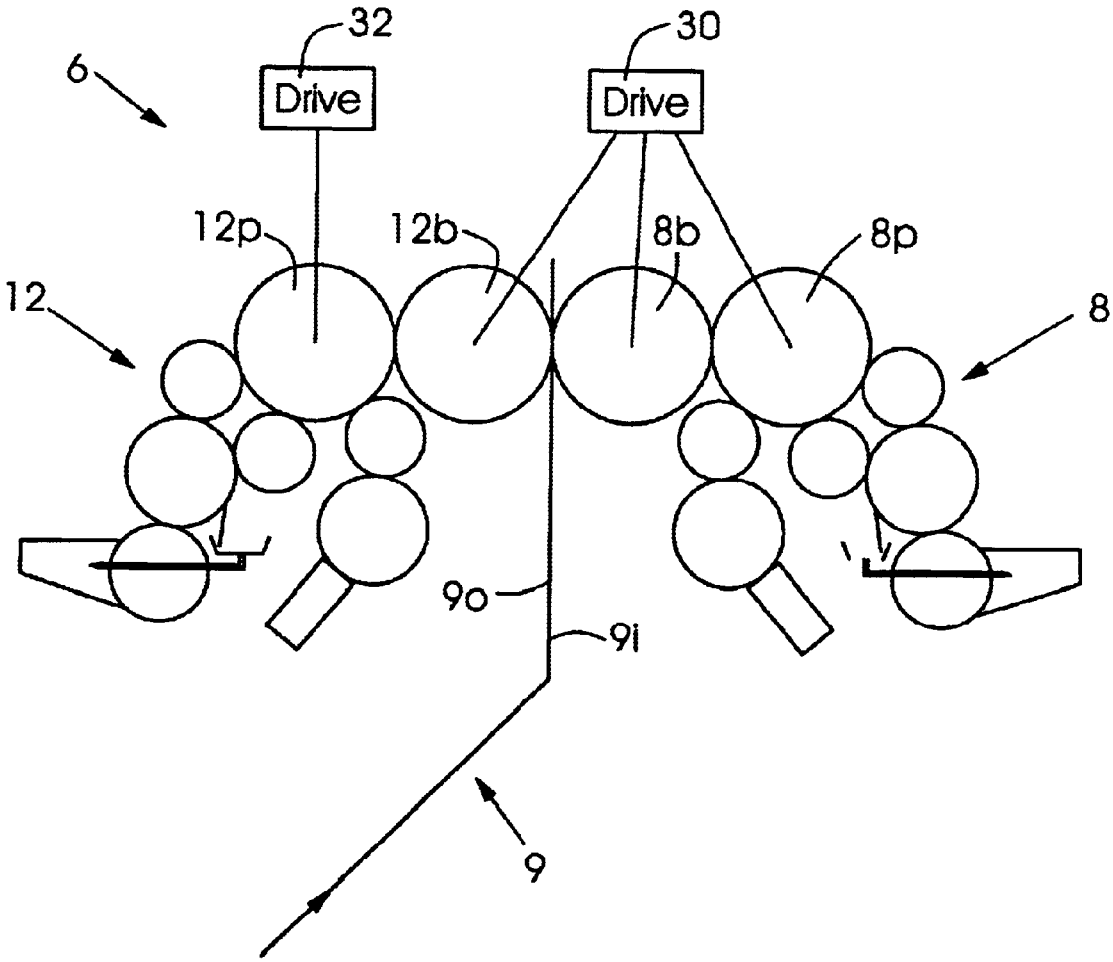
FIG. 2 is an expanded schematic view of a printing unit of the web-offset printing press of FIG. 1.

FIG. 2 outlines this arrangement in greater detail, showing an expanded view of printing unit 6. Assuming for example that a printing plate on plate cylinder 12*p* will be replaced, the plate cylinder 12*p* may be moved to an off-impression position (e.g. decoupled from the associated blanket cylinder 12*b* and moved away from the blanket cylinder 12*b*), stopped, and equipped with a new printing plate. During this time, the blanket cylinder 12*b* may continue rotating to ensure that the nip 26 of printing unit 6 retains the traveling web 9 in a stable position as it receives an image on side 9*i* from couple 8. It can be understood that during the period when plate cylinder 12*p* is off impression, blanket cylinder 12*b* applies no image to the outer side 9*o* of the web 9. Instead, the fourth color image is printed on the outer side 9*o* by the couple 11 of printing unit 4.

In an exemplary embodiment, blanket cylinder 12*b* is driven, for example, by the same drive 30 which rotates plate cylinder 8*p* and blanket cylinder 8*b* of couple 8. Plate cylinder 12*p* may be releasably coupled to this same drive 30 or may be connected to an optional separate drive 32. This ensures that blanket cylinder 12*b* continues to rotate and maintain the nip 26 while plate cylinder 12*p* is changed.

It can be understood that the selection of drives and drive arrangements should not be limited to the configuration described here. Any configuration of drives that allows the blanket cylinder associated with the stopped plate cylinder to maintain pressure for the opposing couple at the nip is sufficient for purposes of the present invention. Moreover, for purposes of the present invention, when it is stated that one or more elements are driven by separate or distinct "drives," it is meant to include arrangements such as selectable couplings to a single drive (e.g. to a single motor).

When couple 12 is on impression—that is, when couple 12 is applying, for example, the fourth color image to the outer side 9*o* of web 9—the printing plate on plate cylinder lip of couple 11 may be replaced as described above with respect to couple 12. At the same time, blanket cylinder 11*b* will continue to rotate. Accordingly, plate cylinder 11*p* may also be driven, for example, by a separate drive or may be releasably coupled to the drive of blanket cylinder 11*b*.

The arrangement and use of couples 7, 13 and 14 for web 10 may be, for example, identical to the arrangement and use of couples 8, 11, and 12 for web 9. Specifically, couple 7 may print the single-color image on side 10*i* of web 10, while couples 13 and 14 may alternatingly print the fourth color image on side 10*o* of web 10. With respect to drives, plate cylinder 14*p* may, for example, be rotated by a different drive than the drive of blanket cylinder 14*b*. Similarly, plate cylinder 13*p* of couple 13 may be driven by its own drive or releasably coupled to the drive of blanket cylinder 13*b*.

In an exemplary embodiment of printing unit 5, cylinders 7*p*, 7*b*, and 14*b* are driven by a single drive, while plate cylinder 14*p* is driven by a different drive. In an exemplary embodiment of printing unit 4, blanket cylinders 11*b* and 13*b* are driven by the same drive (not shown), while plate cylinders 11*p* and 13*p* are each rotated by separate drives (not shown).

A method of changing a printing plate on the fly in a two-web offset printing press includes (referring, for example, to FIG. 2) taking a plate cylinder 12*p* off impression (i.e. separating plate cylinder 12*p* from blanket cylinder 12*b*), slowing plate cylinder 12*p* to a stop, replacing the printing plate on plate cylinder 12*p* with a replacement printing plate, accelerating the plate cylinder 12*p* to synchronize it with the blanket cylinder 12*b*, and placing the plate cylinder 12*p* on impression. During the entire method, blanket cylinders 12*b* and 8*b* may be maintained, for example, at a constant speed. Thus the press may continue to print using other couples, for example couples 1–5. It can also be understood that while the plate cylinder 12*p* is changed, the web may still receive images from other couples in the press, allowing printing of multiple webs to continue even while plate changes occur.

It can be understood by one skilled in the art that the printing press of the present invention as shown in FIG. 1 may be used to print a different set of images for a different set of webs. For example, with a different configuration of rollers and webs (the rollers, which are not shown, guiding the webs), the press of FIG. 1 may print a six-color image on both sides of a single web. Similarly, if edition changes are not necessary, the unit may be used to print, for example, a 5/1 image on two webs. The addition of more printing units also allows, for example, two 4/2 images to be printed (with on-the-fly edition changes), and so on. Many other configurations are possible.

In addition, the order, arrangement, and composition of printing units 1–6 may be altered For example, a web or webs may pass through printing units 4–6 before passing through units 1–3. Also, the units 4, 5, and 6 may, for example, be placed in a different order. In another embodiment of the press according to the present invention, additional units may be added, so that, for example, those plate cylinders that print the one-color image on the inner side of each web may be selectively taken off-impression to change the printing plates as described above. Moreover, each couple need not be opposed by another couple. Rather, an impression cylinder, for example, may be used to create a nip for one or more webs. The plate cylinder of the couple associated with an impression cylinder may be taken off impression, without affecting the movement of the web or webs, so long as the blanket cylinder continues to rotate. Other variations will be clear to one skilled in the art.

Finally, it can be understood that the order in which plate cylinders 11*p*, 12*p*, 13*p*, and 14*p* are replaced may vary. All that is required for on-the-fly edition changes (in the illustrated embodiment) is that one of couples 11 and 12 be on impression and one of couples 13 and 14 be on impression.

The device and method according to the present invention have been described with respect to several exemplary embodiments. It can be understood, however, that there are many other variations of the above described embodiments which will be apparent to those skilled in the art. It is understood that these modifications are within the teaching of the present invention, which is to be limited only by the claims appended hereto.

What is claimed is:

1. A printing press for printing a first web and a second web simultaneously, comprising:

a first blanket cylinder;

a second blanket cylinder, the first and second blanket cylinders being arranged to form a two-web nip the first and second webs passing through the two-web nip back-to-back;

a first plate cylinder associated with the first blanket cylinder, the first plate cylinder being selectively moveable between a first contacting position in which the first plate cylinder contacts the first blanket cylinder and a first off-impression position in which the first plate cylinder is remote from the first blanket cylinder; and a second plate cylinder associated with the second blanket cylinder, the second plate cylinder being selectively movable between a second contacting position in which the second plate cylinder contacts the second blanket cylinder and a second off-impression position in which the second plate cylinder is remote from the second blanket cylinder, the first and second blanket cylinders maintaining the two-web nip regardless of the positions of the first and second plate cylinders;

a third blanket cylinder;

an opposing cylinder, the opposing cylinder being one of a fourth blanket cylinder and an impression cylinder, the opposing cylinder and the third blanket cylinder being arranged to form a first one-web nip, one of the first web and second web passing through the one-web nip after passage through the two-web nip; and a third plate cylinder, the third plate cylinder being selectively movable from a third contacting position in which the third plate cylinder contacts the third blanket cylinder and a third off-impression position in which the third plate cylinder is remote from the third blanket cylinder, the third blanket cylinder and the opposing cylinder maintaining the first one-web nip regardless of the position of the third plate cylinder.

2. The printing press according to claim 1, further comprising a first drive for driving the first and second blanket cylinders; and a second drive for driving the third blanket cylinder and the opposing cylinder.

3. The printing press according to claim 2, further comprising a third drive for driving the first plate cylinder.

4. The printing press according to claim 1, wherein the first web passes through the first one-web nip alone, the first web selectively receiving a first color image on its outer side via one of the first blanket cylinder and the third blanket cylinder.

5. The printing press according to claim 4, further comprising a first drive for driving the first and second blanket cylinders; and a second drive for driving the third blanket cylinder and the opposing cylinder.

6. The printing press according to claim 5, further comprising a third drive for driving the first plate cylinder.

7. The printing press according to claim 4, the opposing cylinder being the fourth blanket cylinder, further comprising a fourth plate cylinder, the fourth plate cylinder contacting the fourth blanket cylinder, wherein the first web receives a second color image on its inner side via the fourth plate cylinder.

8. The printing press according to claim 7, further comprising a first drive for driving the first and second blanket cylinders;

a second drive for driving the third blanket cylinder, the fourth blanket cylinder, and the fourth plate cylinder; and a third drive for driving the first plate cylinder.

9. A printing press for printing a first web and a second web simultaneously, comprising:

a first blanket cylinder and a second blanket cylinder, the first and second blanket cylinders being arranged to form a two-web nip, the first and second webs passing through the two-web nip back-to-back;

a first plate cylinder associated with the first blanket cylinder, the first plate cylinder being selectively moveable between a first contacting position in which the first plate cylinder contacts the first blanket cylinder and a first off-impression position in which the first plate cylinder is remote from the first blanket cylinder;

a second plate cylinder associated with the second blanket cylinder, the second plate cylinder being selectively movable between a second contacting position in which the second plate cylinder contacts the second blanket cylinder and a second off-impression position in which the second plate cylinder is remote from the second blanket cylinder, the first and second blanket cylinders maintaining the two-web nip regardless of the positions of the first and second plate cylinders;

a third blanket cylinder and a fourth blanket cylinder, the third and forth blanket cylinders being arranged to form a first one-web nip; and a third plate cylinder, the third plate cylinder being selectively movable from a third contacting position in which the third plate cylinder contacts the third blanket cylinder and a third off-impression position in which the third plate cylinder is remote from the third blanket cylinder, the third blanket cylinder and the opposing cylinder maintaining the first one-web nip regardless of the position of the third plate cylinder;

a fourth plate cylinder, the fourth plate cylinder contacting the fourth blanket cylinder, wherein the first web receives a second color image on its inner side via the fourth plate cylinder;

a fifth blanket cylinder and a sixth blanket cylinder, the fifth and sixth blanket cylinders arranged to form a second one-web nip;

a fifth plate cylinder, the fifth plate cylinder being selectively movable from a fifth contacting position in which the fifth plate cylinder contacts the fifth plate cylinder and a fifth off-impression position in which the fifth plate cylinder is remote from the fifth blanket cylinder, the fifth and sixth blanket cylinders maintaining the second one-web nip regardless of the position of the fifth plate cylinder; and a sixth plate cylinder, the sixth plate cylinder contacting the sixth blanket cylinder;

wherein the first web passes through the first one-web nip alone, the first web selectively receiving a first color image on its outer side via one of the first blanket cylinder and the third blanket cylinder; and wherein the second web passes through the second one-web nip alone, the second web selectively receiving the first color image on its outer side via one of the second blanket cylinder and the fifth blanket cylinder and the second web receiving the second color image on its inner side via the sixth blanket cylinder.

10. A printing press comprising:

a first printing unit including first and second blanket cylinders forming a first dual-web nip, a first plate cylinder forming a second nip between the first plate cylinder and the first blanket cylinder, and a second plate cylinder forming a third nip between the second blanket cylinder and the second plate cylinder, wherein the first and second webs are fed back-to-back through the first nip of the first printing unit so that a first side of the first web contacts the first blanket cylinder and a first side of the second web contacts the second blanket cylinder, the first plate cylinder being movable between a first cylinder contacting position in which the first plate cylinder contacts the first blanket cylinder to form the second nip of the first printing unit and a first cylinder off-impression position in which the first plate cylinder is separated from the first blanket cylinder, and the second plate cylinder being movable between a second cylinder contacting position in which the second plate cylinder contacts the second blanket cylinder to form the third nip of the first printing unit and a second cylinder off-impression position in which the second plate cylinder is separated from the second blanket cylinder;

a second printing unit including first and second blanket cylinders forming a first dual-web nip, a first plate cylinder forming a second nip between the first plate cylinder and the first blanket cylinder, and a second plate cylinder forming a third nip between the second blanket cylinder and the second plate cylinder, wherein only the first web is fed to the first nip of the second printing unit so that the first side of the first web contacts the first blanket cylinder and a second side of the first web contacts the second blanket cylinder, the first plate cylinder being movable between a first cylinder contacting position in which the first plate cylinder contacts the first blanket cylinder to form the second nip of the second printing unit and a first cylinder off-impression position in which the first plate cylinder is separated from the first blanket cylinder; and a third printing unit including first and second blanket cylinders forming a first dual-web nip, a first plate cylinder forming a second nip between the first plate cylinder and the first blanket cylinder, and a second plate cylinder forming a third nip between the second blanket cylinder and the second plate cylinder, wherein only the second web is fed to the first nip of the third printing unit so that the first side of the second web contacts the first blanket cylinder and a second side of the second web contacts the second blanket cylinder, the first plate cylinder being movable between a first cylinder contacting position in which the first plate cylinder contacts the first blanket cylinder to form the second nip of the third printing unit and a first cylinder off-impression position in which the first plate cylinder is separated from the first blanket cylinder.

11. The printing press according to claim 10, wherein the second plate cylinder of the second printing unit is movable between a second cylinder contacting position in which the second plate cylinder contacts the second blanket cylinder of the second printing unit to form the second nip of the second printing unit and a second cylinder off-impression position in which the second plate cylinder is separated from the second blanket cylinder.

12. The printing press according to claim 10, wherein the second plate cylinder of the third printing unit is movable between a second cylinder contacting position in which the second plate cylinder contacts the second blanket cylinder of the third printing unit to form the third nip of the third printing unit and a second cylinder off-impression position in which the second plate cylinder is separated from the second blanket cylinder.

13. A printing press comprising:

a dual-web printing unit including first and second blanket cylinders forming a dual-web nip, and first and second plate cylinders associated with the first and second blanket cylinders, the dual-web printing unit receiving first and second webs, the first and second webs traveling back-to-back through the dual-web nip;

a first single-web printing unit including first and second blanket cylinders forming a first single-web nip and first and second plate cylinders associated with the first and second blanket cylinders the first single-web printing unit receiving the first web, the first web traveling through the first single-web nip; and a second single-web printing unit including first and second blanket cylinders forming a second single-web nip, and first and second plate cylinders associated with the first and second blanket cylinders, the second single-web printing unit receiving the second web, the second web traveling through the second single-web nip;

wherein first and second plate cylinders of the dual-web printing unit, a first plate cylinder of the first single-web printing unit, and a first plate cylinder of the second single-web printing unit may each be selectively taken off impression without interrupting movement of either of the first and second webs through any of the nips;

wherein an outer side of the first web selectively receives a first color image from at least one of a first blanket cylinder of the dual-web printing unit and a first blanket cylinder of the first single-web printing unit;

wherein an inner side of the first web receives a second color image from a second blanket cylinder of the first single-web printing unit;

wherein an outer side of the second web selectively receives the first color image from at least one of a second blanket cylinder of the dual-web printing unit and a first blanket cylinder of the second single-web printing unit; and wherein an inner side of the second web receives the second color image from a second blanket cylinder of the second single-web printing unit.

* * * * *